United States Patent [19]

Hause

[11] 4,049,180

[45] Sept. 20, 1977

[54] STITCHING HEAD BYPASS APPARATUS

[75] Inventor: Jonathan E. Hause, Canandaigua, N.Y.

[73] Assignee: Xerox Corporation, Stamford, Conn.

[21] Appl. No.: 689,319

[22] Filed: May 24, 1976

[51] Int. Cl.[2] ..... B27F 7/18

[52] U.S. Cl. ..... 227/78

[58] Field of Search ..... 227/78, 109

[56] References Cited

U.S. PATENT DOCUMENTS

| | | | |
|---|---|---|---|
| 1,021,869 | 4/1912 | Havener | 227/78 |
| 2,999,242 | 9/1961 | Young et al. | 227/78 |
| 3,076,196 | 2/1963 | Mestre | 227/39 |
| 3,515,329 | 6/1970 | Cilione | 227/78 |

*Primary Examiner*—Granville Y. Custer, Jr.

[57] ABSTRACT

A fastening apparatus such as a stitcher or stapler for fastening a quantity of individual sheets together to form a pack is disclosed. The apparatus as aforesaid includes a tray for receiving sheets to be fastened, there being jogging means to co-align the sheet edges preparatory to fastening, and at least two stitching or stapling heads for driving staples through the assembled sheets. A transport ejects the finished pack into an output bin. Apparatus for selectively uncoupling one of the stitching heads from the head driving mechanism to thereby disable the head without removing or disassembling the head is provided.

2 Claims, 10 Drawing Figures

STITCHING HEAD BYPASS APPARATUS

This invention relates to a fastening apparatus, and more particularly to an improved fastening apparatus which permits one or more of the apparatus stitching heads to be bypassed.

Machines for fastening a pack of loose sheets together in relatively permanent fashion are well known to the art and come in several varieties. One type of machine, called a stitcher, utilizes wire taken from a supply reel, and formed by dies in the machine into a staple at the initiation of the fastening operation. Following this, the newly formed staple is driven through the assemblage of loose sheets and clenched to form a relatively permanent attachment.

Stitchers of the foregoing type normally incorporate one or two stitching heads depending on whether the sheet pack is to be fastened at one point or at two points. However, as can be envisioned, it is often desirable to change from one type of fastening arrangement to the other. Heretofore, to prevent unnecessary wear on the head and indentation or marking of the sheet material, this has required removal of the unused stitching head, a job which is relatively time consuming and which requires the services of a trained operator, particularly when the previously removed head is re-installed.

It is therefore a principle object of the present invention to provide a new and improved fastening apparatus.

It is a further object of the present invention to provide a fastening machine incorporating means to permit one or more of the machine fastening devices to be quickly and readily engaged and disengage and without removal from the machine.

It is an object of the present invention to provide an improved stitching/stapling apparatus having an arrangement for permitting at least one of the apparatus stitching/stapling heads to be bypassed without removing or unloading the head.

It is a further object of the present invention to provide an improved stitching head incorporating means to enable an untrained or casual operator to uncouple the head while retaining the head in an operative position and ready for immediate reuse upon recoupling thereof.

It is an object of the present invention to provide an improved apparatus for selectively coupling and uncoupling stapling/stitching heads from the head driving mechanism.

This invention relates to an apparatus for fastening as assemblage of sheets together to form a pack using one or more fasteners, the combination of at least two fastening heads for driving fasteners through the sheets to form the pack, each of the heads including a drive ram supported for reciprocable movement toward and away from the sheet assemblage, fastener supply means for supplying fasteners to the heads, the ram serving to drive the fasteners through the sheet assemblage whereby to form the pack, and anvil means opposite the ram for receipt of the sheet assemblage therebetween, the anvil means cooperating with the ram to clench the portions of the fastener protruding through the sheet assemblage whereby to prevent withdrawal of the fastener and disassembly of the pack; and drive means for reciprocating the ram, at least one of the drive means including a reciprocable driving link, an interposer for drivingly coupling the driving link to the ram, means supporting the interposer for movement between a first position where the interposer drivingly couples the driving link with the ram and a second position where the interposer uncouples the driving link from the ram, and lock means for selectively retaining the interposer in either of the first or second positions, whereby to selectively operate or shutdown the head associated therewith.

Other objects and advantages will be apparent from the ensuing description and drawings in which.

Figure 1:
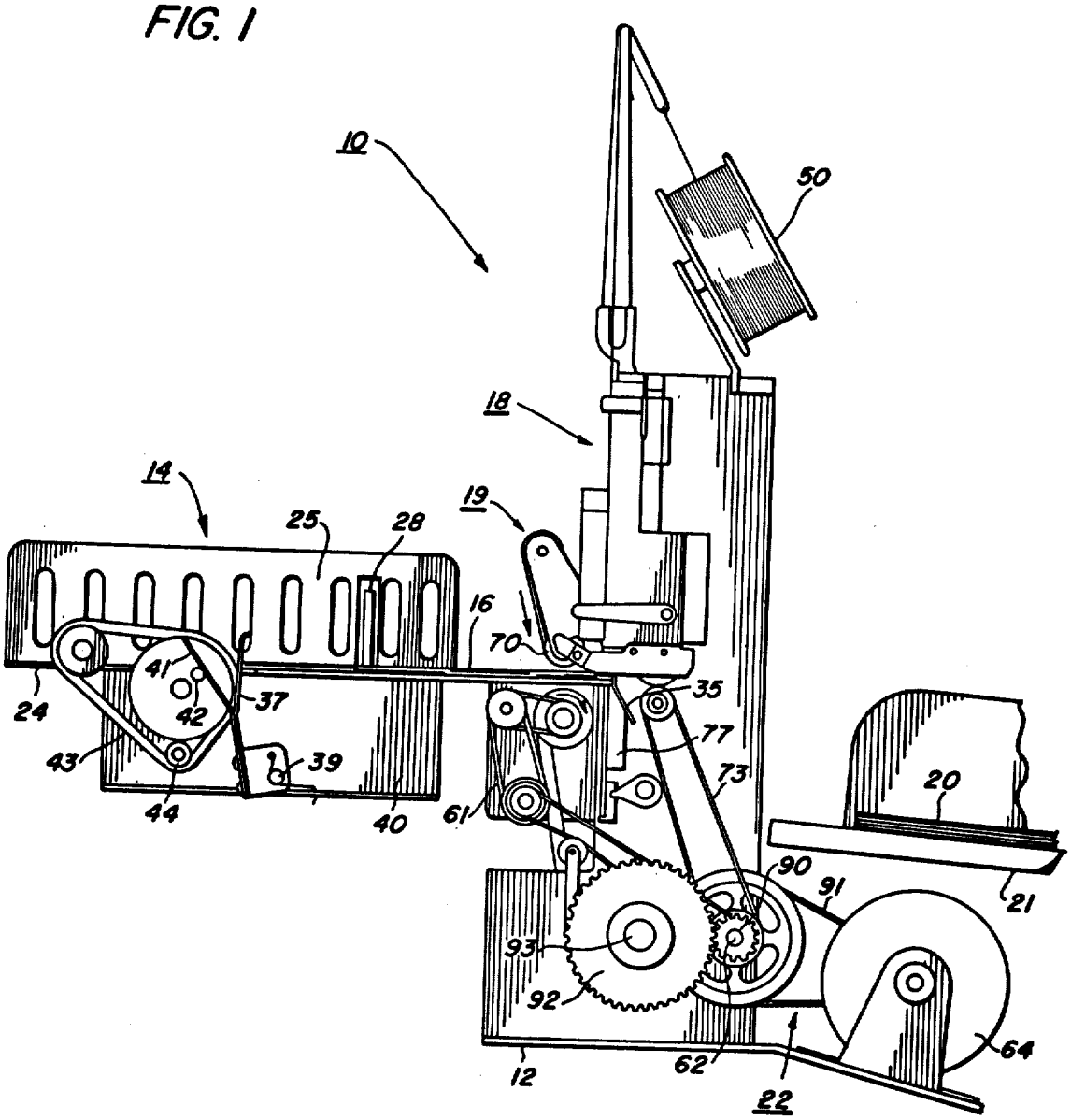
FIG. 1 is a side view in partial section of an exemplary fastening apparatus incorporating the improved stitching head bypass of the present invention.
Figure 7:
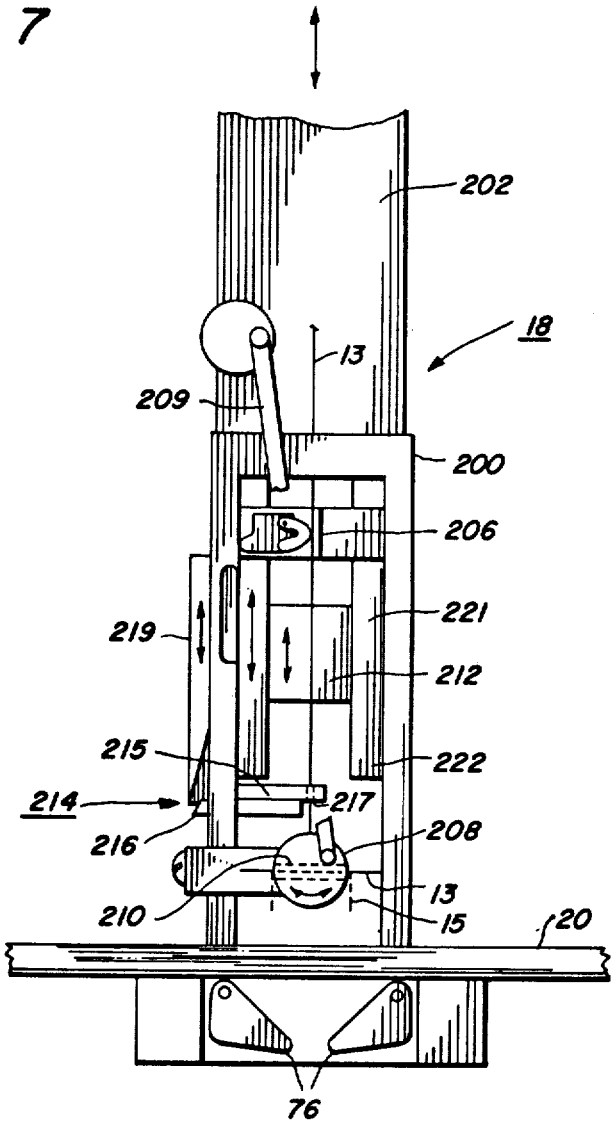
Figure 8:
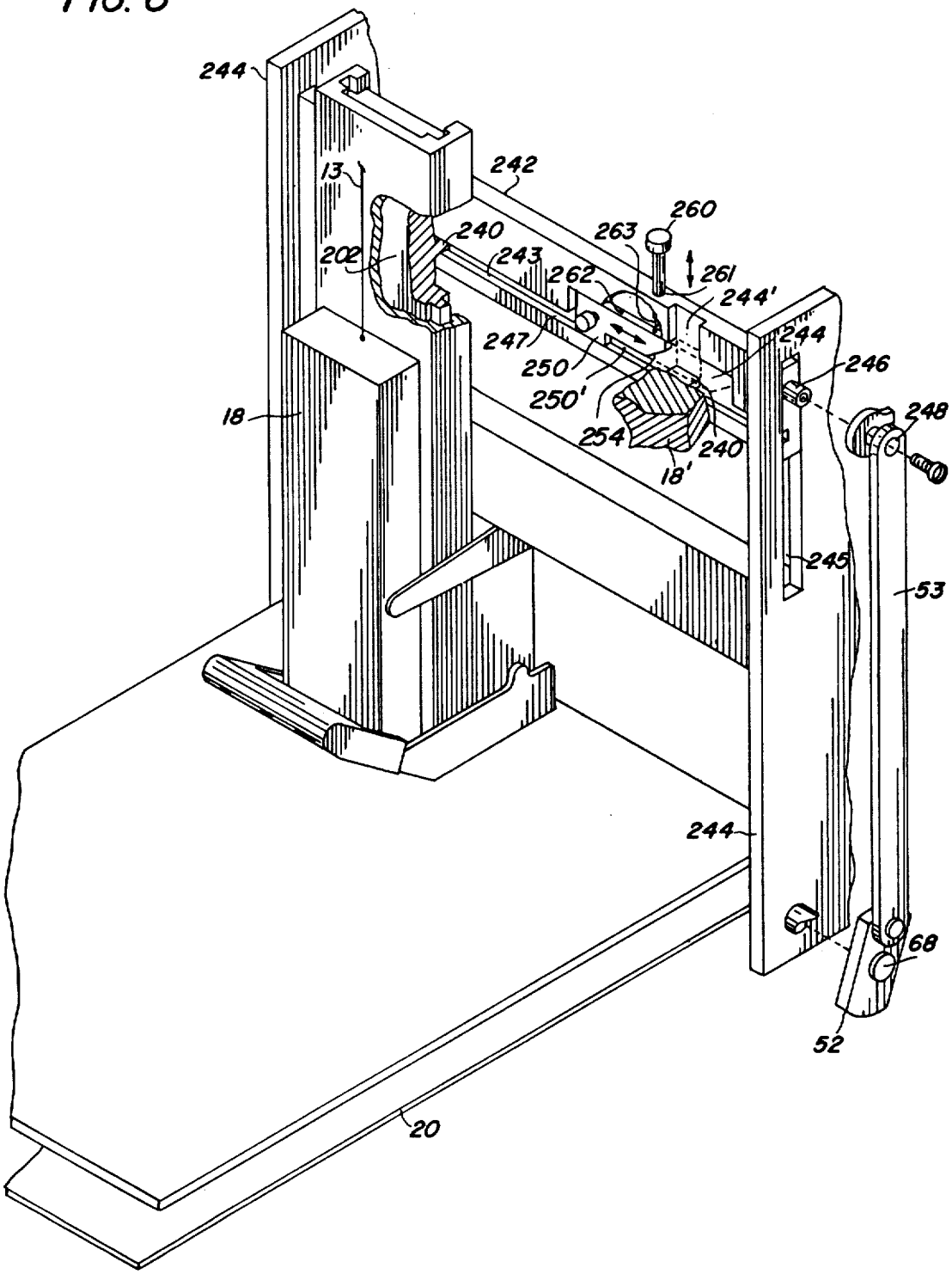
Figure 9A:
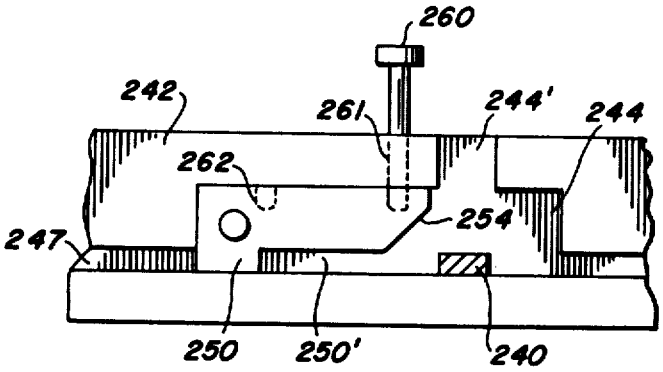
Figure 9B:
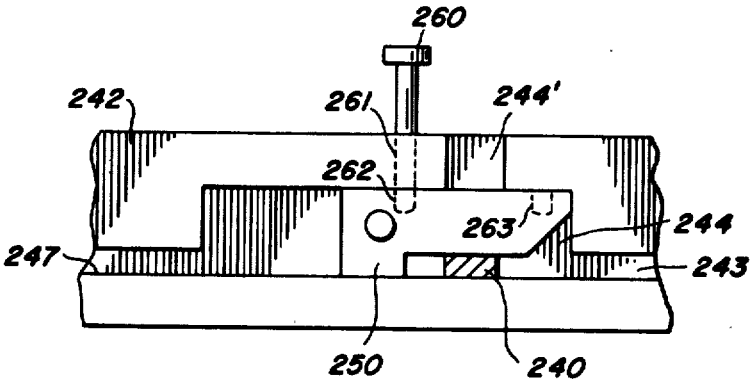

FIG. 7 is a sectional view showing the details of a stitching head of the type used with the fastening apparatus shown in FIG. 1; and FIG. 8 is an isometric view illustrating a multiple stitching head arrangement, and details of the stitching head bypass of the present invention FIG. 9*a* is a view showing the interposer retracted and the stitching head disengaged; and FIG. 9*b* is a view showing the interposer advanced and the stitching head engaged.

Referring particularly to FIG. 1 of the drawings, there is shown an exemplary fastening apparatus, designated generally by the numeral 10, adapted to incorporate the bypass arrangement of the present invention. Fastening apparatus 10 includes a free standing support or frame, designated generally by the numeral 12, on which a sheet tray 14 for receiving sheets 16 to be fastened, at least two stitching or stapling heads 18 for fastening discrete groups of sheets 16 into packs 20, an output bin 21 for receiving the fastened packs 20 of sheets 16, and transport means 19 for ejecting the finished packs 20 from under stitching heads 18 into bin 21 are mounted. A suitable driving mechanism 22 is provided for operating stitching heads 18, transport 19, and other ancillary components in integrated relationship as will appear more fully herein.

Figure 2:
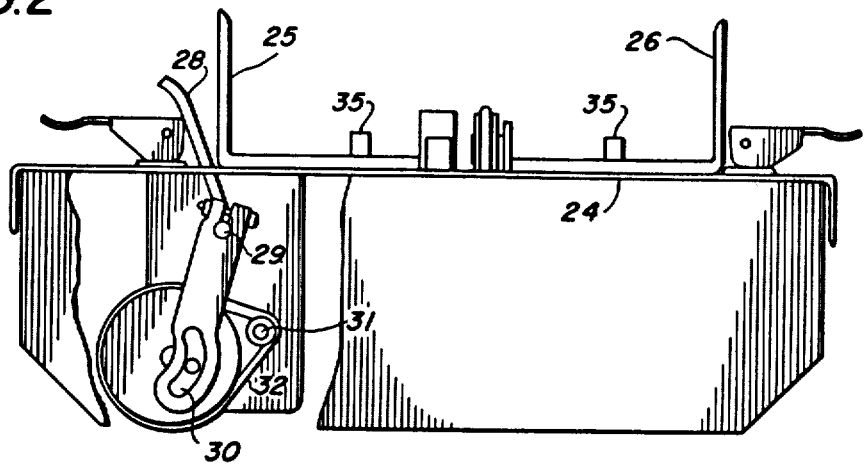
FIG. 2 is an end view of the fastening apparatus shown in FIG. 1 illustrating details of the sheet receiving tray.
Figure 3:
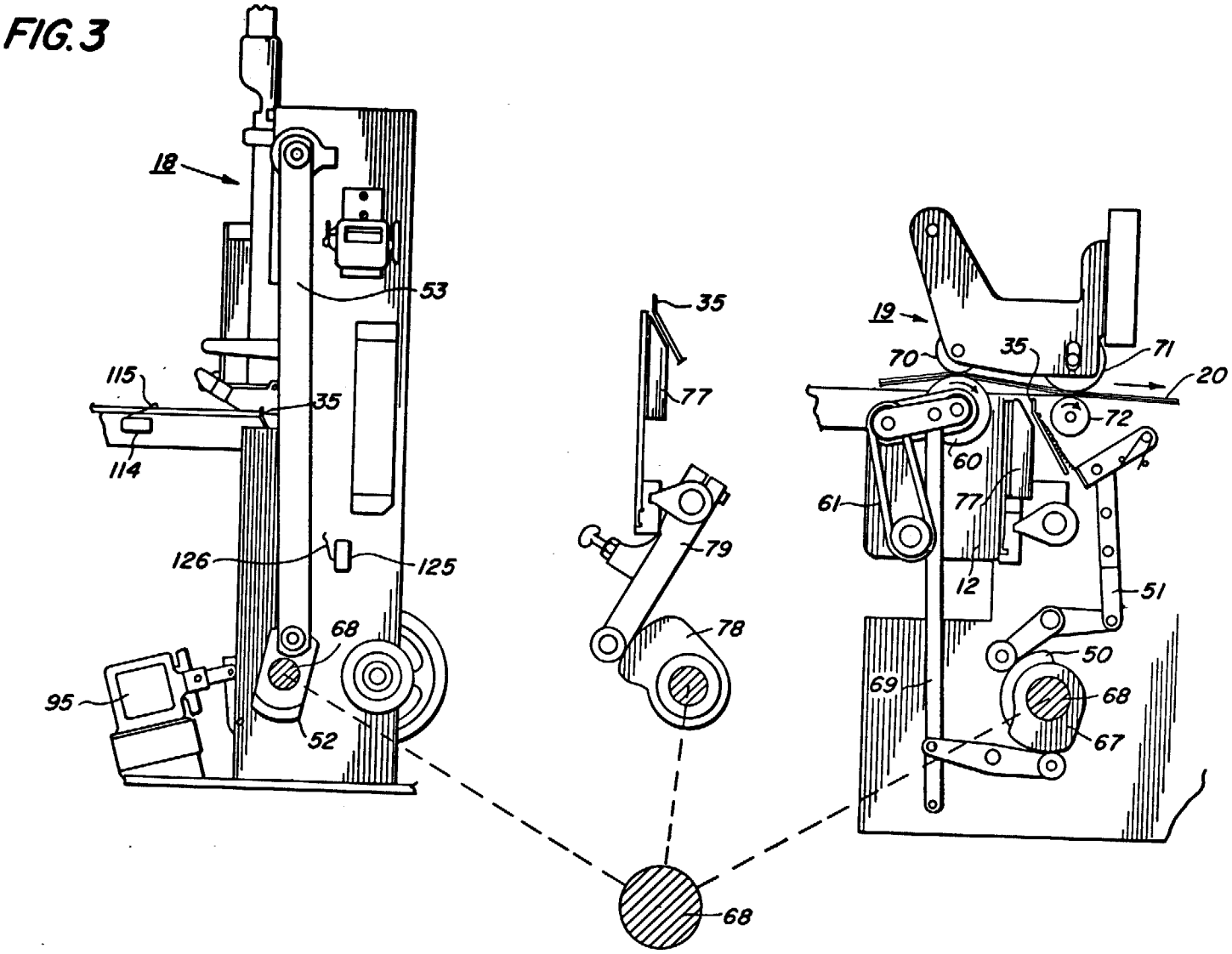
FIG. 3 is a view illustrating the drive train for the machine shown in FIG. 1.

As seen best in FIGS. 1, 2 and 3, tray 14 comprises a platform 24 flanked on either side by upstanding guides 25, 26. As will be understood by those skilled in the art, one or both of the guides 25, 26 are adjustable toward and away from one another to vary the effective width of tray 14 in correlation with the width of sheets 16 being fastened. To align the sheets, one or more finger-like joggers 28 are provided. Joggers 28, which protrude upwardly above platform 24, are suitably supported for adjusting movement with side guide 25. Joggers 28 are carried by rock shaft 29 which in turn is driven in an oscillatory manner by means of eccentric 30. Eccentric 30 is rotated by side jogger motor 31 through belt and pulley drive 32.

A pair of rectractable stops 35 serve to locate the leading edge of sheets 16 under stitching heads 18. In order to align the ends of the sheets 16 in tray 14, finger-like joggers 37 are provided adjacent the rear of platform 24. Joggers 37 are spacedly supported by a rock shaft 39. Arm 41 drivingly connects rock shaft 39 with an eccentric 42. Eccentric 42 is rotatably driven through belt and pulley means 43 by end jogger motor 44. Belt and pulley means 43 includes a pair of idler pulleys 46, 47 and drive pulley 48 of jogger motor 44. Pulleys 46, 47, 48 have feed belt 49 stretched thereabout. To accommodate different size sheets, the subframe 40 supporting joggers 37 is moved longitudinally toward or away from edge stops 35, suitable slots (not shown) in platform 24 accommodating movement of joggers 37. Suitable locking means (not shown) are provided to retain subframe 40 and joggers 37 in the position selected.

Stitching heads 18 comprise any suitable commercially available stapling or stitching mechanism of the type effective to drive a generally inverted U-shaped staple 15, normally made of metal, through a pack or assemblage of sheets 16. In the exemplary fastening apparatus 10, a pair of reciprocable stitching heads are provided, heads 18, 18' functioning, on the downward stroke, to take a partially formed staple, made previously from wire 13 drawn from wire supply spool 50 and complete the forming of the staple into a generally inverted U-shape. With further movement of the mechanism, the staple is driven through the assemblage of sheets 16 in tray 14 and, in cooperation with anvils 76 clenched to lock the staple in place. Eccentric drive crank 52, supported upon drive shaft 68, operates stitching heads 18 through link 53 in a timed manner as will appear more fully herein. For a more complete description of the operation of stitching heads of the type illustrated, reference may be had to U.S. Pat. No. 3,076,196 issued Feb. 5, 1963.

Stops 35, which serve to locate the leading edge of the sheets 16 resting in tray 14, are supported for up and down movement into and out of the path of movement of sheets 16. Stops 35 are raised and lowered in timed relationship with operation of stitching heads 18 by means of a cam operated linkage 51, cam 50 on drive shaft 68 being provided for this purpose.

Transport means 19, which serves to eject the finished packs 20 when stitching is completed, includes an eject roller 60 swingably supported below tray platform 26. Belt and pulley means 61 drivingly connect eject roller 60 with power take-off shaft 62. Shaft 62, which is driven by main drive motor 64 through belt 91, turns roller 60 in the direction shown by the solid line arrow of FIG. 1 upon energization of motor 64. Cam 67 on drive shaft 68 works through linkage 69 to raise and lower eject roller 60 in timed relationship to operation of the fastening apparatus 10.

Front and rear discharge rollers 70, 71 are rotatably supported above platform 26 on either side of stitching heads 18. Discharge roller 71 cooperates with lower roller 72 to form a pinch roll pair between which the finished pack 20 moves, rollers 71, 72 serving to carry the pack 20 into bin 21. Discharge roller 70 is supported opposite eject roller 60, roller 70 being spaced above the level of platform 24 to permit sheets 16 to be freely stacked or piled thereunder when loading fastening apparatus 10. Roller 70 cooperates with eject roller 60 upon raising of roller 60 to engage and initiate discharge of the stapled pack 20 out from under stitching heads 18 and into the nip of roller pair 71, 72. Roller pair 71, 72 sustain movement of the finished pack 20 into bin 21. Discharge roller 72 is driven by motor 64 through belts 73, 91. Contact of roller 72 with roller 71 drives roller 71, and through belt 74, roller 70 in the direction shown on the solid line arrow of FIG. 3.

As described, stitching heads 18 include lower anvils 76, (see FIG. 7) for clenching the staple ends. Anvils 76 are pivotally supported upon framework 12 and driven from reciprocable member 77. Member 77 is driven from drive shaft 68 through cam and link means 78, 79 respectively.

Figure 5:
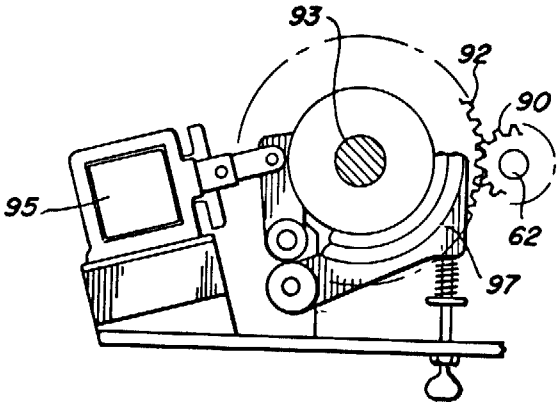
FIG. 5 is a cross sectional view of the combination clutch/brake shown in FIG. 4 taken along line 5 — 5 thereof.
Figure 4:
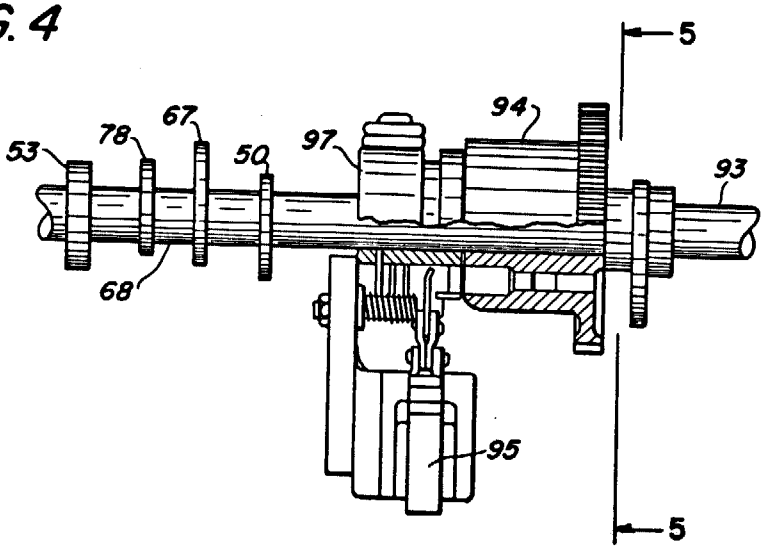
FIG. 4 is a top view showing details of the combination clutch/brake for the drive train shown in FIG. 3.

Referring particularly to FIGS. 4 and 5, a gear 90 on power take off shaft 62 meshes with gear 92 on clutch input shaft 93. Power take off shaft 62 is driven by main drive motor 64 via belt 91. Shaft 93 comprises the input shaft to a solenoid operated clutch 94 adapted, upon energization of clutch solenoid 95, to couple input shaft 93 with drive shaft 68 through a single revolution. Clutch 94 includes a braking mechanism 97 effective whenever clutch 94 is disengaged to brake drive shaft 68 to a stop. As noted, drive shaft 68 carries the operating cams 50, 67 and 78 for paper stops 35, eject roller 60, and anvil drive member 77 respectively. In addition, operating crank 52 for stitching heads 18 is mounted on shaft 68. As will be understood, the configuration of cams 50, 67 and 78 and the throw of crank 52 are chosen to provide integrated operation of the different components driven therefrom.

Figure 6:
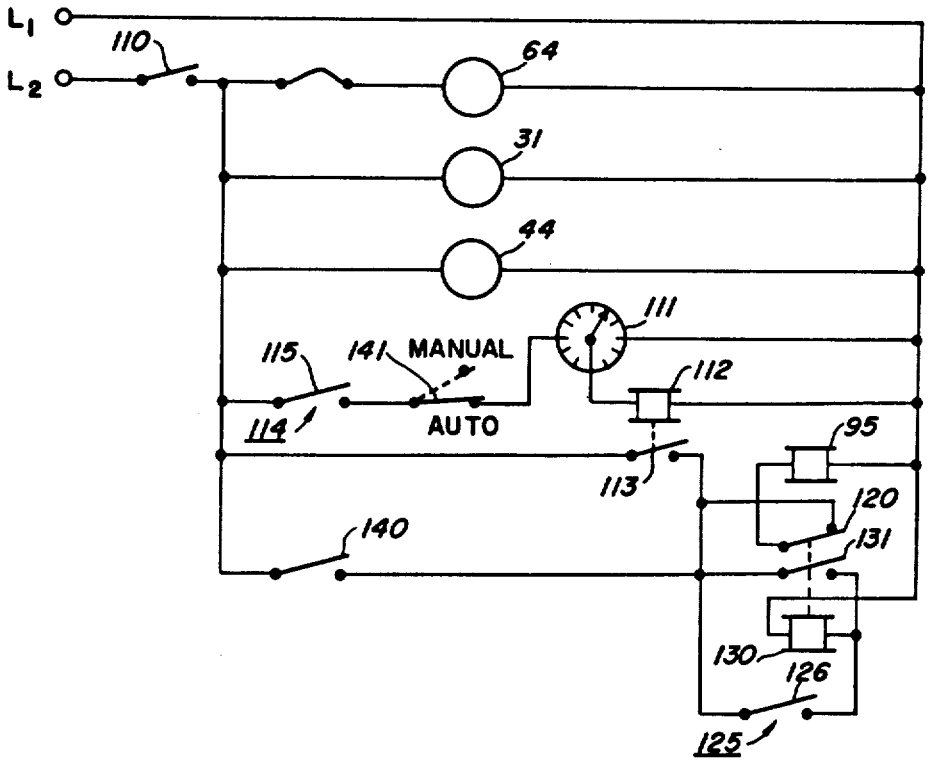
FIG. 6 is a schematic of the fastening apparatus control circuit.

Referring now to FIG. 6, main drive motor 64, side jogger motor 31, and rear jogger motor 44 are connected through on/off switch 110 across a suitable source of electrical energy represented by leads L1, L2. A control relay 112 which includes an adjustable delay circuit 111 for delaying for a selected interval energization of the relay 112, is connected through tray switch 114 across the leads L1, L2. Tray switch 114 is suitably supported on paper tray 14 with switch arm 115 thereof projecting slightly above platform 24 and into the tray area. Disposition of one or more sheets 16 into tray 14 depresses switch arm 115 to actuate switch 114 and energize circuit 111. Circuit 111, after the selected interval, energizes relay 112.

Solenoid 95 of clutch 94 is connected through normally closed contact 120 of a safety relay 130 and a normally open contact 113 of control relay 112 across leads L1, L2. A safety switch 125 is provided, switch 125 being supported on the machine framework 12 such that switch arm 126 thereof is disposed in the path of movement of the stitching head drive link 53. In this arrangement, link 53, on the return stroke of stitching heads 18, momentarily engages switch arm 126 to close safety switch 125. Switch 125 is disposed in series with safety relay 130. A normally open contact 131 of relay 130 bypasses switch 125.

In operation of fastening apparatus 10, on/off switch 110 is closed to energize the main drive motor 64, side jogger motor 31, and rear jogger motor 44. Energization of main drive motor 64 operates via power take-off shaft 62, eject roller 60, and discharge rollers 70, 71, 72, rollers 60, 70, 71, 72 rotating in the direction shown by the solid line arrows of FIG. 1. At the same time, clutch input shaft 93 is rotated. With clutch 94 disengaged and shaft brake 97 engaged, drive shaft 68 is stationary.

Energization of side jogger motor 31 oscillates side joggers 28 back and forth to align the side edges of any sheets 16 placed in tray 14 with one another. Similarily, energization of rear jogger motor 44 oscillates end joggers 37 to increment the leading edge of sheets 16 placed in tray 14 forward against stops 35 with concurrent aligning the sheet leading and trailing edges with one another.

On disposition of a pack of sheets 16 to be fastened on platform 24 of tray 14, switch 114 actuated to complete an energizing circuit to time delay circuit 111. Following a preset interval, the length of which is dependent upon the setting of circuit 111, control relay 112 is energized closing contact 113 thereof. The aforesaid interval may be used to add additional sheets to those in tray 14 as well as permitting the side and rear joggers 28, 37 respectively to complete alignment of the sheets in tray 14.

With closure of relay contact 113, an energizing circuit is completed to clutch solenoid 95 engaging clutch 94 and releasing brake 97. Engagement of clutch 94 couples clutch input shaft 93 with drive shaft 68 to rotate shaft 68 through one revolution. Rotation of shaft 68 operates in timed sequence as determined by the configuration of cams 50, 67, 78 and the throw of crank 52 stitching heads 18 and anvils 76 to stitch the sheets 16 together, remove stops 35, and raise eject roller 60 to move, in cooperation with rollers 70, 71, 72, the stapled pack 20 into discharge bin 21.

During operation of stitching heads 18, drive link 53 to stitching heads 18 momentarily closes safety switch 125 to complete a circuit to safety relay 130. Relay 130 closes contact 131 while opening contact 120 thereof. Opening of relay contact 120 interrupts the circuit to clutch solenoid 95 to assure disengagement of clutch 94 and engagement of brake 97 after one revolution and prevent reactivation of stitching heads 18 before the previous stitching cycle is fully completed in the event that tray switch 114 is prematurely reclosed, or fails to open following stitching. Safety relay 130 remains energized until either tray switch 114 is opened or on/off switch 110 is released.

To enable manual operation of the fastening apparatus 10, a control switch 140 is disposed in series with the normally closed relay contact 120 of safety relay 130 and clutch solenoid 95 across leads L1, L2. Switch 140 is also arranged in series with normally open safety switch 125 and safety relay contact 131 across the leads L1, L2. A manual selector switch 141 is provided in the energizing circuit to time delay circuit 111. Opening of the selector switch 141 disables time delay circuit 111 and renders actuation of tray switch 114 by sheets disposed in tray 14 ineffective.

In operation, selector switch 141 is opened to disable tray switch 114 and time delay circuit 111. Manual closure of switch 140 completes a circuit to clutch solenoid 95 to energize clutch 94 and operate the stitching apparatus 10 through one cycle in the manner described heretofore. During the stitching operation, safety switch 125 is closed by crank 52 to energize safety relay 130 which in turn opens relay contact 120 to interrupt the circuit to the clutch solenoid 95 while closing relay holding contact 131 thereof. This protects against repeated or inaduertent operation of the stitching apparatus 10 should switch 140 be held closed.

Referring particularly to FIGS. 7 and 8, each stitching head 18 includes a driving bar 202 supported for generally vertical up and down movement on head frame member 200. Bar 202 functions as the driver for the operating components that make up a stitching head 18, components which serve to advance the proper length of wire 13, cut off the wire, form the cut off length of wire into a staple 15, drive the staple into the sheet pack 20, and clench the staple ends.

To advance wire 13, a reciprocable wire feeder 206 is provided. Feeder 206 functions, on descent of driving bar 202, to advance a predetermined length of wire 13 forward to swivel 208. Swivel 208, which is generally cylindrical, is rotatably supported on head frame member 200 below wire feeder 206. Swivel 208 is provided with a slot-like recess 210 on the inner end thereof within which the wire 13 extends, the length of wire advanced by feeder 206 being such that the terminal ends of the wire project beyond either side of swivel 208. Suitable bias means (not shown) serve to bias swivel 208 in a direction axially thereof to bring recess 210 thereof into alignment with wire 13 for the receipt of wire 13 therewithin. The exterior surfaces of swivel 208 adjoining recess 210 are beveled to enable a drive bar 212 to force swivel 208 aside during descent of bar 212. This allows bar 212 to engage and drive the finished staple 15 into the sheet pack 20 therebelow.

A wire cutter 214 is disposed between wire feeder 206 and swivel 208. Cutter 214 consists of relatively movable upper and lower cutting bars 215, 216 respectively. Upper bar 215 has a wire retaining opening 217 therethrough to prevent lateral displacement of wire 13 as lower cutting bar 216 moves forward to engage and cut off the wire. Slide 219, reciprocably supported on frame 200, serves to drive lower cutting bar 216 forward on descent of driving bar 202.

Bender bar 221 is slidably supported for generally vertical up and down movement in frame 200 below driving bar 202, bender bar 221 being drivingly coupled to driving bar 202 through bar 212. Bender bar 221 has a pair of spaced downwardly depending legs 222 cooperable with swivel 208 on downward movement of bar 221 to engage and bend the projecting ends of the length of wire disposed in slot-like recess 210 of swivel 208. For this purpose, swivel 208 is turned 90° via drive link 209 such that the length of wire is substantially horizontal as shown in solid lines in FIG. 7.

Drive bar or ram 212 is slidably supported for movement within bender bar 221, bar 212 being coupled to driving bar 202. The lower end of drive bar 212 functions on downward movement of bar 212, to contact the aforedescribed beveled surfaces of swivel 208 to force swivel 208 outwardly thereby releasing the now formed staple 15 from recess 210 thereof. Further downward movement of drive bar 212, in cooperation with bender bar 221, drives the depending legs of the inverted U-shaped staple 15 through the sheet pack 20. Anvils 76 are raised to bend the portions of staple 15 projecting through pack 20 inwardly to clench the staple and complete the operation.

Referring particularly to FIG. 8, driving bar 202 is provided with a driving tang 240 thereon for engagement with drive plate 242. Drive plate 242 is supported for generally vertical up and down movement in a pair of frame uprights 244, uprights 244 being slotted at 245 for this purpose. A drive pin 246 projects from one end of rod 242, pin 246 being received in opening 248 of drive link 53 to drivingly couple drive plate 242 with link 53.

In the embodiment illustrated in FIG. 8 two stitching heads are envisioned. For convenience, the stitching head pair are designated by the numerals 18 and 18'. The driving tang 240 of one head 18 is disposed in drive slot 243 of drive plate 242 so that stitching head 18 is operated on reciprocation of plate 242.

To permit ready disengagement of one stitching head, i.e. head 18', as in the case where the user desires to provide only a single staple in sheet pack 20, the driving tang 240 of head 18' is coupled to drive plate 242 via a laterally displaceable interposer 250. For this purpose, the drive slot 243 in drive plate 242 is enlarged at 244 for receipt of interposer 250 therewithin.

Interposer 250 is in the shape of a right angle. The depending leg of interposer 250 rests on the lower surface 247 of drive slot 243. The horizontal leg of interposer 250, which is spaced above and substantially parallel with surface 247, cooperates with surface 247 to form a slot-like recess 250' dimensionally equivalent to driving recess 243 for receipt of driving tag 240 of head 18' upon displacement of interposer to the dotted line position in FIG. 8. To facilitate movement of interposer 250 over tang 240, the leading edge of interposer 250 is beveled at 254.

When it is desired to disengage stitching head 18' interposer 18 is moved to the solid line position shown in FIG. 8, the slot-like extension 244' in the recessed portion 244 of drive plate 242 permitting plate 242 to reciprocate without engaging the drive tang 240.

To retain interposer 250 in either the disengaged (solid line) or engaged (dotted line) position, a lock pin 260 is provided. Lock pin 260, which is slidably disposed in opening 261 in drive plate 242, is disposable in either opening 262 or 263 in interposer 250 to retain interposer 250 in the position selected.

By disposing interposer 250 in either the disengaged (solid line) or engaged (dotted line) position, operation of stitching head 18' may be readily controlled to provide either single or double staple fastening. This is effected without disassembly or removal of stitching 18' and without changing or upsetting the off times critical adjustment of head 18' or requiring reloading of wire feeder 206 and knife 216. As a result, head 18' remains in a standby condition ready for immediate use upon repositioning of interposer 250.

It is understood that stitching head 18 may be controlled in the same manner either alternately or together with head 18'.

While the invention has been described with reference to the structure disclosed, it is not confined to the details set forth, but is intended to cover such modifications or changes as may come within the scope of the following claims.

What is claimed is:

1. In an apparatus for fastening an assemblage of sheets together to form a pack using one more fasteners, the combination of:

a. at least two fastening heads for driving fasteners through said sheets to form said pack, each of said heads including
   1. a drive ram supported for reciprocable movement toward and away from said sheet assemblage to drive said fasteners through said sheet assemblage whereby to form said pack, and
   2. anvil means opposite said ram for receipt of said sheet assemblage therebetween, said anvil means cooperating with said ram to clench the portions of said fastener protruding through said sheet assemblage whereby to prevent withdrawal of said fastener and disassembly of said pack; and b. drive means for reciprocating said ram, at least one of said drive means including
   1. a reciprocable driver plate,
   2. an interposer for drivingly coupling said driver plate to said ram,
   3. means supporting said interposer for movement between a first position where said interposer drivingly couples said driver plate with said ram and a second position where said driver plate is not coupled with said ram, and
   4. lock means for selectively retaining said interposer in either of said first or second positions, means supporting said driver plate for reciprocable driving movement, a slot-like driving recess in said driver plate adjacent each of said stitching heads and including an enlarged portion, said drive ram including a projecting tang member disposed in said enlarged portion of said driving recess said interposer being disposed in said driving recess for selective movement between said first position to engage said tang member with said driver plate and drive said one stitching head and said second position wherein said interposer is withdrawn from between said driver plate and said tang member whereby engagement of said tang member with said driver plate is prevented.

2. The apparatus according to claim 1 wherein said interposer comprises a plate-like member supported for slidable movement between said first and second position.

* * * * *